US008079421B2

(12) United States Patent
Wagner

(10) Patent No.: US 8,079,421 B2
(45) Date of Patent: Dec. 20, 2011

(54) METHOD AND DEVICE FOR PREVENTING AND EXTINGUISHING FIRE IN AN ENCLOSED SPACE

(75) Inventor: Ernst-Werner Wagner, Winsen/Aller (DE)

(73) Assignee: Amrona AG, Zug (CH)

( * ) Notice: Subject to any disclaimer, the term of this patent is extended or adjusted under 35 U.S.C. 154(b) by 322 days.

(21) Appl. No.: 12/222,096

(22) Filed: Aug. 1, 2008

(65) Prior Publication Data

US 2009/0038811 A1 Feb. 12, 2009

(30) Foreign Application Priority Data

Aug. 1, 2007 (EP) ..... 07113646

(51) Int. Cl.
*A62C 3/00* (2006.01)

(52) U.S. Cl. ..... 169/46; 169/45; 169/47; 169/5; 169/11; 169/43; 239/61

(58) Field of Classification Search ..... 169/45, 169/46, 47, 43, 5, 11, 10, 15, 66; 239/61
See application file for complete search history.

(56) References Cited

U.S. PATENT DOCUMENTS 3,438,445 A * 4/1969 MacCracken ..... 169/44
4,616,694 A * 10/1986 Hsieh ..... 165/47
4,846,410 A * 7/1989 Jewett et al. ..... 241/31
6,634,598 B2 * 10/2003 Susko ..... 244/135 R
6,739,399 B2 * 5/2004 Wagner et al. ..... 169/45
7,013,905 B2 * 3/2006 Jones et al. ..... 137/12
7,594,545 B2 * 9/2009 Love ..... 169/45
2001/0029750 A1 10/2001 Kotliar
2003/0226669 A1 * 12/2003 Wagner ..... 169/45
2008/0135265 A1 * 6/2008 Wagner et al. ..... 169/45

FOREIGN PATENT DOCUMENTS

DE 4413074 A1 1/1998
DE 10249126 A1 6/2004
DE 10249126 A1 * 6/2006
DE 102005023101 A1 * 12/2006
DE 102005023101 A1 12/2006

* cited by examiner

*Primary Examiner* — Len Tran
*Assistant Examiner* — Trevor E McGraw
(74) *Attorney, Agent, or Firm* — Jean C. Edwards, Esq.; Edwards Neils PLLC

(57) ABSTRACT

A method and device for preventing fire and for extinguishing fire in an enclosed space in which a permanent negative pressure is set, includes fresh air being supplied in a regulated manner to the compartment atmosphere as supply air and exhaust air being discharged from the compartment atmosphere in a regulated manner, and wherein should a fire occur or to prevent a fire, an extinguishing agent which is gaseous under normal conditions is supplied to the compartment atmosphere as the supply air. In order to achieve a relieving of pressure without changing the set negative pressure, or upon a sudden flooding of the space with the gaseous extinguishing agent, the total volume flow of fresh air and/or extinguishing agent supplied to the compartment atmosphere as supply air is at all times less than or equal to the volume flow of the exhaust air discharged from the compartment atmosphere.

23 Claims, 3 Drawing Sheets

METHOD AND DEVICE FOR PREVENTING AND EXTINGUISHING FIRE IN AN ENCLOSED SPACE

CROSS-REFERENCE TO RELATED APPLICATIONS

The present invention claims priority from European Patent Application No. 07 113646.9 filed Aug. 1, 2007, the contents of which are herein incorporated by reference in their entirety.

BACKGROUND OF THE INVENTION

1. Field of the Invention

The present invention relates to an inerting method for preventing fire and for extinguishing fire in an enclosed space, particularly a laboratory area, wherein fresh air is supplied in regulated manner to the compartment atmosphere as supply air and exhaust air is discharged from the compartment atmosphere in regulated manner, and wherein should a fire occur or to prevent a fire, the compartment atmosphere is fed an extinguishing agent which is gaseous under normal conditions as the supply air. The invention further relates to a device for extinguishing a fire which has broken out in an enclosed space, wherein the device includes at least one mechanism for providing an extinguishing agent which is gaseous under normal conditions and for immediately introducing said gaseous extinguishing agent into the compartment atmosphere of the enclosed space when a fire has broken out in said enclosed space.

2. Description of the Related Art

Supplying the compartment atmosphere of an enclosed space with an extinguishing agent which is gaseous under normal conditions in the event of a fire or to prevent a fire is known in the field of fire-fighting technology. For example, a system (method and device) for extinguishing fires in enclosed spaces is described in the DE 198 11 851 A1 document. In this conventional system, subject to a fire detection signal, an oxygen-displacing extinguishing agent which is gaseous under normal conditions (hereinafter referred to simply as "inert gas") is introduced suddenly into the compartment atmosphere of the enclosed space; i.e., within the shortest possible time frame. The introduction of the inert gas lowers the oxygen content in the compartment atmosphere to a specific predefinable "inertization level." This inertization level corresponds to a reduced oxygen content at which the inflammability of the goods or materials stored in the space is already lowered to the point that they can no longer ignite, thus, a fire which has already broken out will be smothered.

The extinguishing effect resulting from flooding an enclosed space with inert gas is based on the principle of oxygen displacement. As is generally known, "normal" ambient air consists of 21% oxygen by volume, 78% nitrogen by volume and 1% by volume of other gases. For extinguishing purposes or also as a preventative method to protect against fire, the percentage of oxygen in the compartment atmosphere of the area at issue is reduced by introducing an inert gas. An extinguishing or fire preventing effect is known to occur when the percentage of oxygen in the compartment atmosphere falls below a so-called "re-ignition prevention level." The re-ignition prevention level is an inertization level which corresponds to a reduced oxygen concentration at which the goods or materials stored in the area at issue can no longer ignite and/or burn. Accordingly, the re-ignition prevention level, which is usually determined experimentally, depends on the fire load of the area to be protected. The oxygen percentage corresponding to the re-ignition prevention level is usually in a range of between 12% to 15% by volume. In the case of highly flammable matter, for example volatile solvents, however, the oxygen percentage corresponding to the re-ignition prevention level can even be lower than 12% by volume.

According to a guideline just recently issued by the Verband der Sachversicherer (VdS; "Property Insurer's Association"), when an enclosed space ("protected area") is flooded, the oxygen concentration in the protected area should reach the re-ignition prevention level within the first 60 seconds of said flooding having been started. This thereby allows effective fire control with inert gas technology so that a fire in the protected area can be completely extinguished within the fire control phase.

In order to meet these requirements, it is necessary, particularly in large-volume areas such as laboratory spaces, production areas or warehouses, to be able to introduce a sufficient volume of inert gas into the compartment atmosphere of the enclosed space as quickly as possible when needed; i.e., within the 60 seconds stipulated by the VdS guideline.

Storing the oxygen-displacing gas used in the inert gas extinguishing method compressed into gas bottles for example lends itself well to this. Alternatively or additionally thereto, it is conceivable to provide for a device to produce an oxygen-displacing gas, for instance a so-called "nitrogen generator," wherein the volume of gas produced by the device per unit of time does however need to be adapted commensurate to the volume of the protected area. This holds especially true when no other inert gas source is provided additionally to the nitrogen generator. When needed, the available volume of inert gas is then piped into the space at issue as quickly as possible, for example through a system of pipes having the corresponding outlet nozzles.

Due to the requirement of the inert gas extinguishing method needing to introduce an oxygen-displacing gas as quickly as possible into the enclosed space, at least at the start of the flooding, in order to render safe and effective fire control, it is essential to structurally provide for pressure relief for the enclosed space in order to prevent damage to at least parts of the shell enclosing the space. Such pressure relief is usually realized by installing pressure relief flaps. The function of pressure relief flaps is to protect the shell of the enclosed space from damage, even when the internal pressure within the space increases relatively quickly, for example due to the sudden introduction of a gaseous extinguishing agent. It is frequently provided to design the pressure relief flaps such that they will open automatically upon an empirically-predefined excess pressure. Opening the pressure relief flaps creates an opening in the shell of the enclosed space through which the excess pressure built up inside the space can escape. It is known for the pressure relief flaps to close again automatically after the excess pressure has been released; i.e., after the pressure has been relieved. To technically realize this self-opening and self-closing of the pressure relief flaps, it is known to use a mechanism with spring-loaded pins.

The disadvantage of this type of mechanical pressure relief can be seen in that the space needed to be provided for same must be estimated in the early planning stage, prior to the structural completion of the enclosed space. The dimensions to the pressure relief flaps to be installed moreover have to be determined in the early planning stage. Particularly needing to be estimated in advance is what the effective area for the air or gas opening provided by the pressure relief flaps will be.

In designing and dimensioning the pressure relief flaps to be employed, conventional approaches often assume a theoretical high pressure which might develop within the enclosed space. For reasons of planning reliability, this theoretical value often needs an additional more or less generous safety margin in order to allow for unplanned pressure loads. Yet installing oversized pressure relief flaps is disadvantageous in terms of cost.

Moreover, it is often the case that an enclosed space which is already equipped with a conventional inert gas fire extinguishing system can only be remodeled or expanded to a limited degree. For example, when restructuring makes structural measures necessary in order to enlarge the volume of the space, additional pressure relief flaps may need to be provided so as to allow for mandatory safety-related requirements.

Nor does the previously-known approach for providing pressure relief allow, or only allows at great structural expense, an artificial pressure ratio intentionally set in the compartment atmosphere prior to the flooding with inert gas to be maintained during the flooding in the case of areas which are already equipped with conventional inert gas fire extinguishing systems and conventional pressure relief. This requirement is for example to be considered in the case of laboratory areas of permanently-reduced compartment pressure compared to the ambient pressure in which lower pressure is set within the area in order to prevent the escape of particles, substances, viruses, etc., with the potential to pose a health hazard. This protective measure afforded by the permanently-set negative pressure would fail if conventional mechanical pressure relief flaps which open outward as needed were used to relieve pressure.

SUMMARY OF THE INVENTION

Based on this problem as set forth, the present invention addresses the task of further developing a fire extinguishing system based on the principle of inertization as well as a fire-extinguishing method of the type cited at the outset to the effect that for an enclosed space permanently set at a negative pressure, a laboratory area in particular, the pressure relief to be provided upon flooding with inert gas over as large an area as possible can be disassociated from the size of the area and the spatial volume, whereby the pressure relief at the same time also allows the negative pressure set in the space to be maintained upon a rapid introduction of inert gas in order to effectively prevent the escape of any health-endangering particles, substances, viruses, etc., contained in the compartment atmosphere, also while the area is being flooded with inert gas.

With respect to the device, this task is solved in accordance with the invention in that the device of the type cited at the outset includes a pressure relief mechanism having a negative-pressure generating mechanism and a control unit, wherein the control unit is designed to control the negative-pressure generating mechanism subject to the pressure prevailing in the compartment atmosphere of the enclosed space (also referred to herein as "compartment pressure") such that the pressure prevailing in the compartment atmosphere does not exceed a predefinable maximum pressure value.

The term "negative-pressure generating mechanism" as used herein refers in principle to any system or mechanism which is designed to lower the pressure prevailing in the interior of the enclosed space, for example, by actively discharging air or gas from the compartment atmosphere of said space. What is essential is that the solution proposed herein only requires that air or gas be removed from the (gaseous) compartment atmosphere. This can occur for example, by removing or discharging the air or gas from the compartment volume of the enclosed space through an exhaust air pipe. It is however also conceivable that the volume of air or gas to be removed from the ambient atmosphere for the purpose of relieving pressure is not discharged from the compartment volume, but rather, is compressed, for example, by means of a compressor, and remains inside the space in compressed form, for example, by buffering the compressed volume of air or gas in a pressure storage reservoir. The pressure storage reservoir can be arranged within or also externally of the interior of the space.

With respect to the method, the task on which the invention is based is solved by having the method of the type as cited at the outset measure the pressure prevailing at the current moment in the compartment atmosphere at least during the method step of the sudden introduction of the extinguishing agent into the compartment atmosphere and then compare the measured pressure value to a predefined maximum pressure value.

A negative pressure is thereafter generated in the enclosed space subject to the results of the comparison such that the momentary measured pressure value will not exceed the predefined maximum pressure value.

The advantages attainable with the inventive solution are obvious. Accordingly, it is not "pressure relief" in the actual sense which is being proposed, but rather an intelligent pressure compensation which compensates for the increasing pressure when extinguishing gas is introduced into the interior of the space. In particular, the compartment pressure set in the compartment atmosphere of the enclosed space prior to the flooding is thereby maintained. This holds true even when the re-ignition prevention level needs to be set within the shortest possible time and in particular within the first 60 seconds after starting the flooding of the compartment atmosphere.

Particularly because the inventive device makes use of a pressure relief mechanism having a negative-pressure generating mechanism actuatable by a control unit, it is advantageously possible to continually compensate the excess pressure building in the compartment atmosphere of the enclosed space at the point in time the extinguishing agent is introduced. The provision of the negative-pressure generating mechanism can in particular achieve a negative pressure in principle being created in the enclosed space, the magnitude of which is adapted to the momentary excess pressure created by introducing the extinguishing agent. The excess pressure created in the enclosed space by introducing the extinguishing agent can thus, be sufficiently compensated at all times.

The negative pressure produced by the negative-pressure generating mechanism is preferably selected so as to at least partly compensate the excess pressure created in the protected area by the sudden introduction of the gaseous extinguishing agent.

To be understood in principle by the phrase "creating a negative pressure" or "producing a negative pressure" as used herein is the active discharging of a volume of air or gas $\Delta V$ from the compartment atmosphere of the enclosed space, in consequence of which the air or gas pressure p in the interior of the space changes in accordance with the following equation specifying the isothermal pressure change with the value of $\Delta p$:

$$\Delta p = -K\frac{\Delta V}{V}$$

whereby K=bulk modulus of the compartment air.

It is inventively provided for the negative-pressure generating mechanism to be actuatable by the control unit. The negative-pressure generating mechanism is preferably controlled such that the pressure prevailing in the compartment atmosphere will not exceed a predefinable maximum pressure value.

It is therefore possible with the inventive solution to use a fire-extinguishing system based on the principle of inertization in a enclosed space having an atmosphere of reduced pressure (negative pressure) in comparison to the air pressure of the normal exterior atmosphere, as can be the case in laboratory areas, for example. With the inventive solution, the negative pressure intentionally set in the protected area can then also be maintained when a gaseous extinguishing agent is introduced into the compartment atmosphere, for example, for the purpose of extinguishing a fire. It is hereby particularly preferred for the maximum pressure value used as the threshold for the pressure to be maintained in the compartment atmosphere to be predefinable at will.

What is preferable is that the pressure compensation or pressure relief achievable with the inventive solution can be disassociated from the spatial design of the enclosed space, and in particular from the dimensions or volume of the space, since the pressure-relieving mechanism can accordingly compensate the change in pressure created in the space upon the introduction of a gaseous extinguishing agent independently of the spatial volume. With the inventive solution, it is thus, not the normal atmospheric pressure which thereby serves as the reference value for the pressure relief to be provided but rather the (negative) pressure set in the interior of the space prior to the flooding with inert gas.

The method according to the invention is a technical realization of preventing or extinguishing a fire with the device as described above. The same advantages described in connection with the inventive device are similarly attainable with the inventive method.

Specifically, the inventive method concerns a particularly easy to realize and yet effective method of preventative fire protection and/or effective, and in particular, reliable, extinguishing of a fire which has broken out in an enclosed space, whereby pressure relief is provided in the form of pressure compensation. Said pressure compensation enables the sufficient compensating of a change in pressure which occurs when the extinguishing agent is introduced into the compartment atmosphere so as to thereby effectively prevent damage to the shell of the space.

This is specifically achieved in that exhaust air is actively discharged from the (gaseous) compartment atmosphere of the protected area at all times; i.e., also during the introduction of an extinguishing agent. A reduced compartment pressure compared to the normal air pressure of the external atmosphere can thus, be maintained in the space at all times; i.e., also during the supplying of the extinguishing agent, and done so by ensuring that the total volume of gas supplied to the compartment atmosphere per unit of time as fresh air and/or as extinguishing agent is in principle less than or equal to the volume discharged or removed from the (gaseous) compartment atmosphere per unit of time as exhaust air.

Advantageous further developments of the inventive method are given below.

Generally applicable in principle is that the inventive inertization method provides for the regulated discharging or removal of exhaust air from the compartment atmosphere. As used herein, the term "compartment atmosphere" refers to the gaseous spatial volume of the enclosed space. Accordingly, the term "discharging exhaust air from the compartment atmosphere" is to be understood as the removal of at least a portion of the exhaust air from the gaseous spatial volume.

As indicated above, the discharging, i.e., removal, of the exhaust air from the gaseous spatial volume can be realized in a number of different ways. For one, at least a portion of the exhaust air can be actively suctioned out of the spatial volume by an exhaust air system. In so doing, the exhaust air is not only discharged; i.e., removed from the compartment atmosphere, but also out of the spatial volume. When the exhaust air system is used to extract exhaust air in a regulated fashion in order to compensate an increase in the compartment pressure occurring upon the supplying of inert gas, said exhaust air system—based on a relative large amount of inert gas being supplied to the spatial volume within the shortest possible time frame in the case of extinguishing a fire—needs to be accordingly designed so as to also suction off or extract the corresponding volume of exhaust air within such a short time frame. An exhaust air system having such a large intake volume is often not feasible or only realized at great financial expense.

For this reason, one preferred realization of the solution according to the invention provides for a negative-pressure generating mechanism which can be realized separately from the exhaust air system and serves to provide the required pressure compensation upon the supplying of the inert gas.

This realization encompasses a deliberate separation of functions: the negative-pressure generating mechanism is realized separately from the exhaust air system and thereby serves to ensure that the pressure prevailing in the compartment atmosphere (also simply called "compartment pressure") does not exceed a predefinable maximum pressure value so that a reduced pressure set in the enclosed space can thereby be effectively maintained, even when a relatively large volume of oxygen-displacing gas is supplied to the compartment atmosphere within the shortest time frame at the start of the inert gas flood.

In one preferred embodiment according to the invention, a compressor designed to condense; i.e., compress, the volume of at least a portion of the exhaust gas to be removed or already discharged from the gaseous compartment atmosphere, is employed as the negative pressure-generating mechanism. The compressor can be disposed in the interior of the space so that the exhaust air compressed by the compressor does not necessarily need to be removed from the spatial volume. Instead, the compressor serves to reduce the volume of exhaust air to be removed from the gaseous spatial atmosphere and by so doing, compensate for the excess pressure which builds with the flood of inert gas.

As indicated above, the compressor can be disposed within the interior of the enclosed space. This embodiment has the advantage of being able to provide pressure compensation without requiring major structural measures. Installing the compressor within the interior of the space lends itself in particular to spaces which cannot, or only at great effort, be equipped or retrofitted with an additional exhaust air pipeline system.

The compressor should in principle have a sufficiently high enough volumetric flow so as to ensure that its intake volume will be greater than or equal to the total volume flow of the supply air fed to the compartment atmosphere as fresh air and/or extinguishing agent. It would thus, be conceivable to employ a turbo compressor as the compressor, for example, the design of which assures continuous operation and is characterized by a high volumetric flow.

Alternatively or additionally to a negative pressure-generating mechanism configured as a compressor, it is of course also conceivable for the exhaust air to be discharged from the compartment atmosphere to be removed from the interior of the space by an exhaust air pipeline system.

One particularly preferred embodiment of the invention in which a compressor disposed either in the interior of or external the space is employed as a negative pressure-generating mechanism, provides for the exhaust air removed/discharged from the gaseous compartment atmosphere and compressed by means of the compressor, to be buffered in compressed form in a high-pressure storage reservoir. As is also the case with the compressor, the high-pressure storage reservoir can be disposed within the space or also external thereof as needed. The disposing of the high-pressure storage reservoir within the interior of the space has the advantage that no major structural measures need to be taken to realize the inventive solution. In particular, there is no need to run additional exhaust air lines through the spatial shell of the enclosed space.

Particularly in the case of a laboratory area, the compartment atmosphere of which can contain material, particles or substances (e.g., viruses) which could potentially pose a health hazard, it is preferable for the exhaust air compressed with the compressor and buffered as needed in the high-pressure storage reservoir, not to be discharged to the external atmosphere until being appropriately treated, in particular filtered and/or sterilized, so as to prevent the release of the potentially harmful material, particles, substances, etc.

Other solutions are however, also in principle conceivable for the negative pressure-generating mechanism. For example, it would be conceivable to make use of mechanisms to reduce the volume of gas in the enclosed space which operate with a fan. One possible realization of the negative pressure-generating mechanism can for example, provide for same to include an intake mechanism and an intake pipe system connected to said intake mechanism. In so doing, it is preferred for a control unit to set the volume of gas or air, the intake mechanism is to suction out of the enclosed space via the intake pipe system per unit of time. It is thus, particularly conceivable in conjunction hereto, for the intake mechanism to be realized as a fan or to include a fan respectively, the rotational speed and/or rotational direction of which can be adjusted by the control unit of the negative pressure-generating mechanism.

This is an easily implemented and yet effective realization of the negative pressure-generating mechanism, whereby the control unit can enable the negative pressure-generating mechanism to effect a particularly precise pressure compensation in the protected area. As noted above, however, consideration is hereby to be given to accordingly configuring the intake mechanism so as to be able to discharge a sufficient volume of exhaust air from the compartment atmosphere per unit of time such that the rapid pressure increase created can at the same time be compensated, even at the start of flooding.

When, with the latter embodiment of the intake mechanism, a fan is provided with not only the rotational speed but also the rotational direction being able to be adjusted by the control unit, it is possible to also use the intake mechanism as a blower mechanism. A blower mechanism is a device which is designed to allow for example active ventilation of the enclosed space. Providing such a blower mechanism can be of particular advantage when smoke still present in the space needs to be extracted after a fire has been extinguished, for example, or when fresh air needs to be introduced into the space (for whatever reason).

With respect to the pressure relief, pressure compensation respectively, realizable with the inventive solution, it is preferable to measure the respective volume flows of the fresh air introduced as supply air, the extracted exhaust air and the extinguishing agent introduced as supply air, in the event of a fire or to prevent a fire, and subsequent thereto, for the respective volume flows to be regulated such that the difference between the total volume flow of the supply air introduced to the compartment atmosphere as fresh air and/or as extinguishing agent and the volume flow of the exhaust air discharged from the compartment atmosphere can have a constant predefinable value at all times. When the enclosed space has a gas/aerosol-tight spatial shell, this predefinable value should amount to zero so as to ensure that despite the addition of supply air in the form of fresh air and/or inert gas, a compartment pressure set in the enclosed space will be maintained (with a certain range of control as needed). As the difference between the supply air volume flow and the exhaust air volume flow can be set to a predefinable value, the compartment pressure can however also be deliberately changed (increased or lowered) in regulated manner.

Alternatively or additionally to the above-cited regulating, it is advantageous to determine the difference between the pressure prevailing in the space (compartment pressure) and the air pressure of the external atmosphere continuously or at predefinable times and/or upon predefinable events and compare same to a predefinable value, and to regulate the total volume flow of the fresh air and/or extinguishing agent introduced into the compartment atmosphere as supply air and the volume flow of the exhaust air discharged from the compartment atmosphere as a function of this comparison. This is a particularly easily realized and yet effective possibility for providing effective pressure compensation in the enclosed space, even when a large volume of an inert gas per unit of time is introduced into the compartment atmosphere as supply air within the shortest period of time, in particular at the start of a fire control phase.

With the latter-cited further development, the control unit is preferably used to perform the comparison and subsequent regulating. The control unit should thereby be designed so as to control, a supply air system allocated to the space, an inert gas source connected to the space, as well as an exhaust air system allocated to the space, and any negative pressure-generating mechanism there may be, such that:

the total volume flow of the fresh air and/or extinguishing agent introduced into the compartment atmosphere as supply air is exactly the same as the volume flow of the exhaust air discharged from the compartment atmosphere when the difference determined between the compartment pressure and the air pressure of the ambient air corresponds to a predefined value; and/or the total volume flow of the fresh air and/or extinguishing agent introduced into the compartment atmosphere as supply air is less than the volume flow of the exhaust air discharged from the compartment atmosphere when the difference determined between the compartment pressure and the air pressure of the ambient air is less than the predefined value.

It is to be noted here that the difference between the air pressure in the space and the air pressure of the external atmosphere can be determined by measuring the pressure prevailing in the space (compartment pressure) and the air pressure of the external atmosphere.

A conceivable example of the pressure-measuring mechanism would be a manometer which uses as the reference pressure the external air pressure; i.e., the air pressure of the external atmosphere. Of course it is also conceivable to use barometers; i.e., pressure-measuring means which use a vacuum as the reference. In principle, so-called "direct measuring devices" are conceivable to realize the pressure-measuring mechanism, same using the force applied by the pressure to be determined, for example by relaying and converting into the corresponding signals the force applied by the pressure mechanically, capacitively, inductively, piezo-resistively or via strain gauge. On the other hand, it is of course, also conceivable to use so-called "indirect measuring devices" which deduce the pressure prevailing in the compartment atmosphere of the enclosed space by measuring the particle number density, the thermal conduction, etc.

Additionally or alternatively to a pressure-measuring mechanism, however, it is of course also conceivable to determine the pressure in the atmosphere of the space mathematically. Such a pressure calculation should preferably take into account the volume of the enclosed space on the one hand and, on the other, the volume of extinguishing agent introduced into the enclosed space. Other embodiments are, however, of course also conceivable here.

As already indicated above, the inventive method serves to set an inertization level in the space in the event of a fire by supplying an oxygen-displacing gas (inert gas) into the compartment atmosphere within the shortest time possible after a fire being detected. In order to be able to detect a fire as promptly as possible and initiate the fire control phase, it is advantageous to measure the compartment atmosphere for the presence of at least one fire characteristic continuously or at predefinable times or upon predefined events, whereby in the event a fire characteristic is detected, the extinguishing agent is supplied to the compartment atmosphere as supply air. The supply of fresh air should simultaneously cease. This thus, enables the re-ignition prevention level characteristic for the en-closed space to be set relatively quickly. It is of course also conceivable, however, that in the event of a fire, the fresh air supply is not discontinued completely but only reduced. This might make sense if, for example, a smoldering fire producing heavy smoke has broken out and needs to be controlled.

Accordingly, a preferred further development of the device according to the invention provides for same to include a mechanism for detecting at least one fire characteristic in the compartment atmosphere of the enclosed space. The inventive system should additionally include an extinguishing agent supply mechanism actuatable by a control unit. The control unit is preferably designed so as to control the extinguishing agent supply mechanism in the event of fire such that the provided extinguishing agent is introduced directly into the compartment atmosphere of the enclosed space, and thus, in the shortest amount of time possible.

The term "fire characteristic" as used herein is to be understood as a physical variable which is subject to measurable changes in the proximity of an incipient fire, e.g., ambient temperature, solid, liquid or gaseous content in the compartment air (accumulation of smoke particles, particulate matter or gases) or the ambient radiation.

The mechanism for detecting at least one fire characteristic can be designed for example as an aspirative system which actively suctions out a representative sample from the compartment atmosphere through a system of pipes or channels, preferably from a plurality of locations. This representative sample can then be fed to a measuring chamber including a detector for detecting a fire characteristic. Of course, fire characteristic sensors are also conceivable; for example installed in the interior of the enclosed space.

In one preferred embodiment, the extinguishing agent supply mechanism controllable by the control unit includes a supply pipe system which is connected on the one hand with an inert gas source; i.e., a mechanism which provides the gaseous extinguishing agent. On the other hand, the supply pipe system should be connected by means of gas outlet nozzles with the interior of the enclosed space. The gas outlet nozzles are preferably disposed in a distributed arrangement within the interior of the enclosed space. The extinguishing agent supply mechanism can be controlled by the appropriate actuating of regulating valves or other such similar mechanisms.

It is of course not imperative, however, for the extinguishing agent supply mechanism to include a supply pipe system connecting the internal area of the enclosed space with an inert gas source disposed external of the enclosed space. It is instead also conceivable for the inert gas source to include, for example, at least one high pressure pipe disposed within the enclosed space. At least a portion of the extinguishing agent provided can be stored under high pressure in this at least one high pressure pipe disposed within the enclosed space. In so doing, it is preferable for the least one high pressure pipe to include an outlet valve allocated to the extinguishing agent supply mechanism and actuatable by the control unit.

In order to store the extinguishing agent, this type of high pressure pipe can for example, also be arranged in a suspended ceiling of the enclosed space or below the ceiling of the space. It is preferable for the high pressure pipe to be designed for a pressure range of between 20 and 30 bar. Of course, other pressure values are just as conceivable here.

It is of particular advantage for a plurality of controllable outlet valves to be preferably arranged on the at least one high pressure pipe so as to enable the most rapid flooding possible of the enclosed space with the gaseous extinguishing agent when needed.

Alternatively or additionally to the latter cited embodiment in which at least a portion of the extinguishing agent provided is stored under high pressure in at least one high pressure pipe, it is also conceivable, however, for the inert gas source to include at least one high-pressure cylinder, and preferably a battery of high-pressure cylinders. These high-pressure cylinders can be arranged externally of the enclosed space. In this case, an associated supply pipe system is provided for the extinguishing agent supply mechanism which connects the at least one high-pressure cylinder or battery of high-pressure cylinders with the interior of the enclosed space.

Such types of high-pressure cylinders can for example, be commercial high-pressure cylinders designed for a pressure range of between 200 and 300 bar. Yet other mechanisms for providing or storing the extinguishing agent are of course also conceivable. What is preferable is that the extinguishing agent provided can be rapidly introduced into the enclosed space in the event of a fire, i.e., within the shortest possible time frame, so as to be able to effectively prevent combustion or fire from spreading within the space. Specifically, the fastest possible fire extinguishing is thus, effected.

Conceivable on the one hand as the gaseous extinguishing agent are inert gases such as for example argon, nitrogen, carbon dioxide or mixtures thereof; i.e., so-called Inergen or Argonite. On the other hand, the inventive solution can also be realized with chemical extinguishing agents.

The extinguishing effect of inert gases results from a displacing of the atmospheric oxygen, referred to as the so-called "smothering effect" which occurs upon falling short of a specific critical limit required for combustion. A fire is usually extinguished at a re-ignition prevention level corresponding to a drop in the oxygen percentage to 13.8% by volume. To achieve this, only about one-third of the volume of air needs to be displaced, which corresponds to an extinguishing gas concentration of 34% by volume. Incendiary agents which need considerably less oxygen to ignite require a correspondingly higher concentration of extinguishing gas, such being the case for example with acetylene, carbon monoxide and hydrogen.

As already indicated above, chemical extinguishing agents such as, for example HFC-227ea or NOVEC®1230 can however, also be used as the gaseous extinguishing agent. The known extinguishing agent specified by the HFC-227ea ISO standard deprives the combustion or fire of heat in the combustion process mainly by physical means (cooling) but also a small chemical offensive, resulting in extinguishing of a fire. This extinguishing agent achieves a fast extinguishing effect. There are also scarcely any restrictions on its use as long as the area to be extinguished is relatively airtight so that the necessary concentration of extinguishing agent can be realized and maintained. At high temperatures, however, undesirable products of decomposition which can pose a grave health risk can develop during the extinguishing process.

The chemical extinguishing agent which is marketed under the trademark NOVEC®1230, is a particularly environmentally-friendly chemical extinguishing agent and dissipates in the atmosphere within approximately 5 days. This chemical extinguishing agent moreover has no adverse effect on the ozone layer nor on the greenhouse effect.

The inventive solution is however, not only suited to cases in which a fire has broken out in an enclosed space, whereby fire control ensues by the sudden introduction of the gaseous extinguishing agent. Rather, the inventive solution also lends itself to effective pressure relief, pressure compensation respectively, without a fire having yet broken out in the enclosed space, wherein only the risk of a fire developing in the enclosed space is to be effectively prevented. For this type of preventative measure based on inertization, it is necessary to provide an inert gas or an inert gas mixture as the gaseous "extinguishing agent." The inert gas or inert gas mixture is thereby fed into the enclosed space at such a volume as to reduce the oxygen content in the compartment atmosphere to a value at which the inflammability of the goods stored in the enclosed space is already lowered to the point where they can no longer ignite. For goods which exhibit normal combustion behavior, this point is an oxygen concentration of approximately 12% by volume. The supplying of the inert gas or inert gas mixture ensues by means of the previously-cited extinguishing agent supply mechanism actuatable by the control unit.

So that the inventive solution will be of particularly effective use for this type of preventative measure, it is preferred for the device to further include an oxygen-measuring mechanism to measure the oxygen content in the compartment atmosphere of the enclosed space. Subject to the oxygen content of the compartment atmosphere of the enclosed space, the control unit issues the corresponding control signal to the extinguishing agent supply mechanism. The control signal indicates whether additional inert gas needs to be supplied to the compartment atmosphere of the enclosed space or whether the supply of inert gas can be stopped since the critical oxygen content value has already been reached in the compartment atmosphere.

To be understood by the term "critical oxygen content value" as used herein is that value for the oxygen content at which the inflammability of the goods stored in the enclosed space is already lowered to the point where they can no longer ignite or are only ignitable at great difficulty.

When the inventive solution is used as a preventative measure against fire, it is preferable for the volume flow of the inert gas or inert gas mixture supplied to the compartment atmosphere for preventative fire protection to be regulated such that a base inertization level is initially set and maintained in the compartment atmosphere, whereby in the event of a fire, the volume flow of the inert gas or inert gas mixture supplied to the compartment atmosphere is to be regulated so as to set and maintain a full inertization level.

The term "base inertization level" as used herein refers to a reduced oxygen content in comparison to the oxygen content of the normal ambient air, yet said reduced oxygen content poses no risk whatsoever to persons or animals so that they can still enter into the protected area without any problem. An example of a base inertization level would be the oxygen content in the protected area corresponding to 15%, 16% or 17% by volume.

Conversely, the term "full inertization level" refers to an oxygen content which has been reduced further compared to the oxygen content of the base inertization level and at which the inflammability of most materials is already lowered to the point of no longer being ignitable. Depending on the fire load within the protected space at issue, the oxygen concentration at the full inertization level is normally 11% to 12% by volume. The full inertization level should thereby correspond to the re-ignition prevention level, although it can of course also correspond to an oxygen concentration which is lower than the oxygen concentration characteristic of the re-ignition prevention level.

Lastly, it is also preferred for the inventive method to determine the quality of the compartment air on a continuous basis or at predefinable times and/or upon predefinable events, whereby the volume flow of the fresh air supplied to the compartment atmosphere as supply air is regulated subject to the determined compartment air quality. In so doing, it is conceivable to indirectly determine the quality of the compartment air, for example by measuring the $CO_2$ content in the compartment air atmosphere.

Particularly when the inventive solution is used in an area in which the compartment atmosphere can contain substances, particles, etc, which are potentially hazardous to health, such as a laboratory area, for example, the exhaust air extracted from the compartment atmosphere should first be treated, in particular filtered or sterilized as need be, prior to being discharged to the external atmosphere. Preferably, however, at least a portion of the exhaust air extracted from the compartment atmosphere can also be fed back into the compartment atmosphere again as fresh air subsequent treatment.

BRIEF DESCRIPTION OF THE DRAWINGS

Reference will be made in the following to the attached drawings in describing preferred embodiments of the inventive device in greater detail. Shown are.

DESCRIPTION OF THE INVENTION

Figure 1:
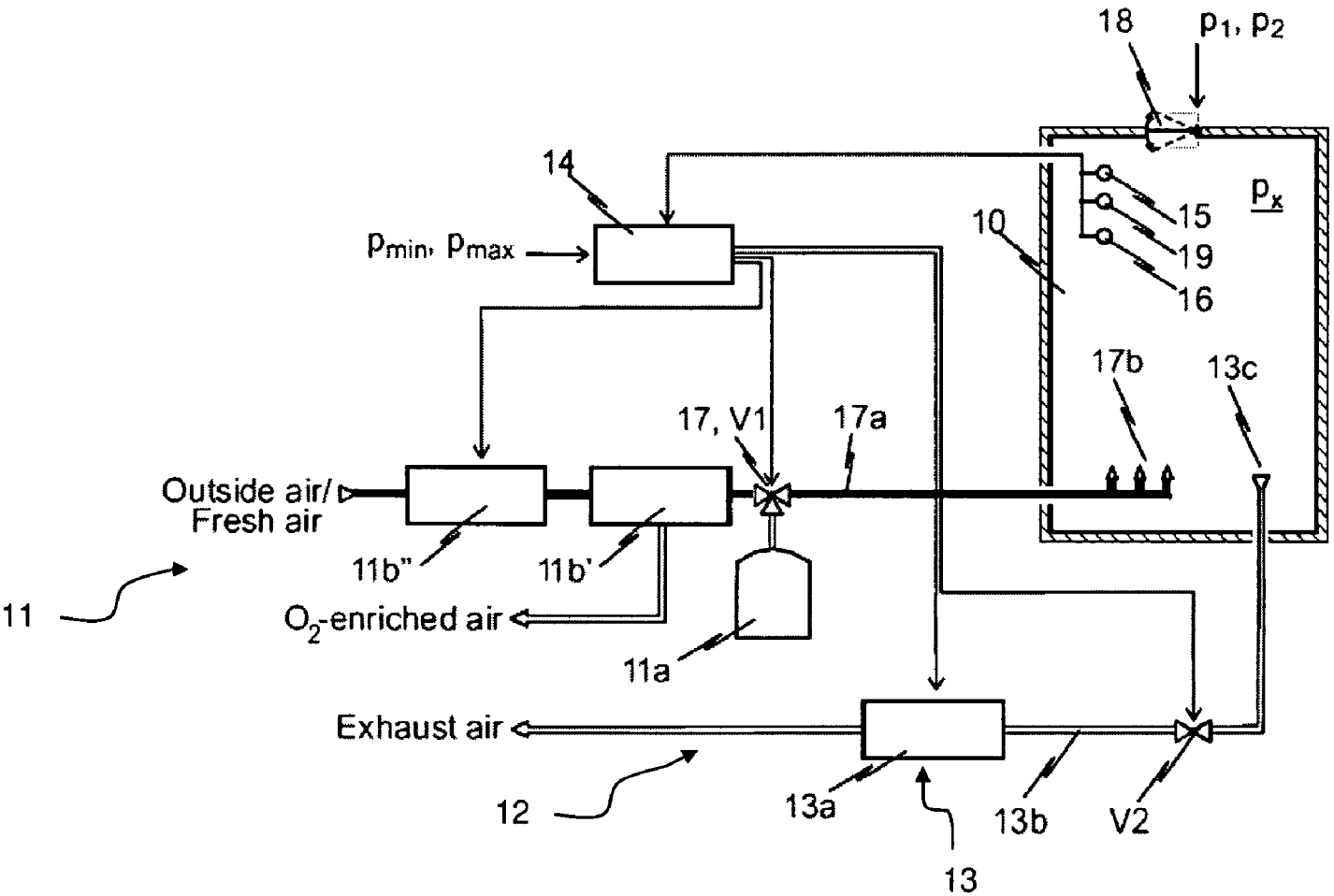
FIG. 1 is a first embodiment of the invention as depicted schematically.

FIG. 1 shows a first embodiment of the device according to the invention for extinguishing a fire which has broken out in an enclosed space 10. The device includes an inert gas source 11 for supplying an extinguishing agent which is gaseous under normal conditions. In the depicted embodiment, the inert gas source 11 includes a gas cylinder battery 11*a* which may comprise high-pressure cylinders arranged external to the space 10 in which the extinguishing agent that is to be supplied, for example—nitrogen—is stored under high pressure.

The gas cylinder battery 11*a* is connected to the space 10 by means of an extinguishing agent supply mechanism 17. Specifically, the extinguishing agent supply mechanism 17 includes a supply pipe system 17*a* on the one hand and, on the other, a gas outlet nozzle system 17*b* arranged within space 10. The extinguishing agent supply mechanism 17 is designed such that in the event of a fire (or when needed), the extinguishing agent stored in the gas cylinder battery 11*a* can be supplied as fast as possible to the enclosed space 10. In particular, the extinguishing gas can thus, discharge through the extinguishing nozzles 17*b* into the compartment atmosphere of space 10 in the shortest amount of time so that a full inertization as required e.g., for extinguishing a fire, can be attained in space 10.

In order to achieve a regulated supplying of the extinguishing agent stored in the gas cylinder battery 11*a* to the compartment atmosphere, a controllable valve V1 is further allocated to the extinguishing agent supply mechanism 17 which, in the event of a fire (or when needed), opens completely or only partly in order to thus connect the gas cylinder battery 11*a* with the space 10 and enable the space 10 to be flooded with the gaseous extinguishing agent.

The embodiment of the inventive device depicted in FIG. 1 further includes a pressure relief mechanism 12. The pressure relief mechanism 12 includes a negative-pressure generating mechanism 13 and a control unit 14.

In the system depicted schematically in FIG. 1, the negative-pressure generating mechanism 13 includes on the one hand, an intake mechanism 13*a* and, on the other, an intake pipe system 13*b* connected to the intake mechanism 13*a*. The intake pipe system 13*b* is connected to the interior of enclosed space 10 by means of suction openings 13*c*. This thus, allows air or gas to be suctioned or extracted out of the interior of the space by means of the intake mechanism 13*a* and released as exhaust air, for example, to the outside.

The control unit 14 for the negative-pressure generating mechanism 13 is connected on the one hand to the intake mechanism 13*a* and, on the other, to an actuatable regulating valve V2 allocated to the negative-pressure generating mechanism 13. In the depicted embodiment, the control unit 14 accordingly assumes not only the task of controlling the extinguishing agent supply mechanism 17, but also the function of controlling the intake mechanism 13*a*.

In detail, the control unit 14 is designed to control the intake mechanism 13*a* of negative-pressure generating mechanism 13 as a function of the pressure $p_x$ prevailing in the compartment atmosphere of enclosed space 10 such that the pressure $p_x$ prevailing in the compartment atmosphere does not exceed a predefinable maximum pressure value $p_{max}$. To this end, the embodiment depicted in FIG. 1 includes a pressure-measuring mechanism 15 to measure the physical pressure of the gas in the compartment atmosphere within the enclosed space 10. The pressure-measuring mechanism 15 is designed to measure the pressure $p_x$ prevailing at the current moment in the compartment atmosphere continuously or at predefined times or upon predefined events and to feed the measured values to the control unit 14. Based on this momentarily prevailing pressure $p_x$, the control unit 14 accordingly actuates the negative-pressure generating mechanism 13; i.e., the intake mechanism 13*a* and/or the regulating valve V2 associated with said negative-pressure generating mechanism 13 in the embodiment depicted in FIG. 1. The control unit 14 compares the momentarily prevailing pressure $p_x$ in the compartment atmosphere of enclosed space 10 to a predefinable maximum pressure value $p_{max}$. Upon the predefinable maximum pressure value $p_{max}$ being exceeded, the control unit 14 issues a corresponding control signal, for example, to the intake mechanism 13*a* of negative-pressure generating mechanism 13.

In the embodiment depicted in FIG. 1, the intake mechanism 13*a* is configured as a fan. Upon the control signal issued by the control unit 14 to the intake mechanism 13*a* when the predefinable maximum pressure value $p_{max}$ is exceeded, preferably both the rotational speed as well as the rotational direction of fan is adjusted. This can thus, in principle, achieve a sufficient volume of gas or air being discharged from the atmosphere of the enclosed space 10 per unit of time through the intake pipe system 13*b* connected to the intake mechanism 13*a*. This ensures that the momentarily prevailing pressure $p_x$ in the compartment atmosphere of space 10 will not exceed the maximum pressure value $p_{max}$, even upon the sudden introduction of a gaseous extinguishing agent.

It is of course also conceivable to not measure the current pressure value $p_x$, but rather, calculate or estimate the volume of extinguishing agent to be introduced. In this case, the control unit 14 should be designed to accordingly actuate the extinguishing agent supply mechanism 17 such that the extinguishing gas provided is supplied to the compartment atmosphere in regulated manner. The amount of extinguishing gas introduced into space 10 can be regulated by the control unit initiating the actuation of the corresponding regulating valve V1 as mentioned above.

In a further development of the solution according to the invention, which is also included in the embodiment depicted schematically in FIG. 1, the fire extinguishing system is additionally equipped with a fire detection system 16 to detect at least one fire characteristic in the compartment atmosphere of enclosed space 10. The fire detection system 16 is preferably configured as an aspirative system, which extracts representative air or gas samples from the compartment atmosphere and feeds same to a detector (not explicitly shown in FIG. 1) for detecting at least one fire characteristic.

The signals sent by the fire detection device 16 to the control unit 14 preferably continuously or at preset times or upon predefined events are used by the control unit 14—if necessary after further processing or evaluation—to applicably control the extinguishing agent supply mechanism 17 and/or the regulating valve V1. Specifically, it is conceivable for the control unit 14 to issue a corresponding signal to the extinguishing agent supply mechanism 17 when the fire detection device 16 detects a fire.

As noted above, in the embodiment depicted in FIG. 1, the control unit 14 is designed to interact with the fan utilized as the intake mechanism 13*a* in a regulated manner so as to discharge the volume of gas or air extracted from the compartment atmosphere to the outside through the intake pipe system 13*b*. Since the control unit 14 can also optionally adjust the rotational direction of fan, a certain volume of air or gas can also be introduced as needed into the atmosphere of the enclosed space 10 with the negative-pressure generating mechanism 13. This can be of particular advantage when space 10 should be subject to a specific excess pressure compared to the external atmosphere. Accordingly, in the embodiment depicted in FIG. 1, the control unit 14 is thus, further designed to control the negative-pressure generating mechanism 13 as a function of the prevailing (momentary) pressure $p_x$ in the compartment atmosphere of enclosed space 10 such that the prevailing pressure $p_x$ in the compartment atmosphere does not fall below a predefinable minimum pressure value $p_{min}$.

To this end, the control unit 14 is to compare the measured or estimated or calculated momentary prevailing pressure $p_x$ in enclosed space 10 to the maximum pressure value $p_{max}$ on the one hand and to the minimum pressure value $p_{min}$ on the other. When the momentary pressure $p_x$ is greater than the maximum pressure value $p_{max}$ or lower than the minimum pressure value $p_{min}$, the negative-pressure generating mechanism 13 is thereby actuated accordingly. The negative-pressure generating mechanism 13 is to be actuated such that the momentary pressure $p_x$ prevailing in the compartment atmosphere of space 10 does not exceed the maximum pressure value $p_{max}$ and does not fall short of the minimum pressure value $p_{min}$.

So that even should the negative-pressure generating mechanism 13 malfunction or fail, it can still in principle be ensured that the prevailing pressure $p_x$ in the compartment atmosphere of enclosed space 10 will not exceed the predefined maximum pressure value $p_{max}$ and/or fall short of the predefined minimum pressure value $p_{min}$, the pressure relief mechanism 12 can further include at least one (mechanical) pressure relief flap 18 as an additional safety measure. The functioning of such a pressure relief flap 18 is generally known in the prior art. The pressure relief flap 18 should be designed so as to open automatically upon a predefinable first pressure value $p_1$ being exceeded so as to enable a release of pressure from the enclosed space 10.

It is preferable for the optionally-provided pressure relief flap 18 to furthermore be designed so as to close again automatically after the falling below of a predefinable first pressure value $p_1$. The predefinable first pressure value $p_1$, at which the pressure relief flap 18 opens automatically upon being exceeded, is preferably greater than or equal to the predefinable maximum pressure value $p_{max}$ which the control unit 14 draws on as a threshold for actuating the negative-pressure generating mechanism 13.

A preferred further development of the latter cited embodiment in which the system further includes at least one preferably mechanically-functioning pressure relief flap 18 for the purpose of ensuring the fail-safe reliability of the pressure relief, provides for the pressure relief flap 18 to be further designed so as to open automatically upon the falling below of a predefinable second pressure value $p_2$ and to close again after the predefinable second pressure value $p_2$ has once again been re-exceeded. This predefinable second pressure value $p_2$ should thereby be less than or equal to the minimum pressure value $p_{min}$ representing the lower threshold for the actuation of the negative-pressure generating mechanism 13.

Figure 2:
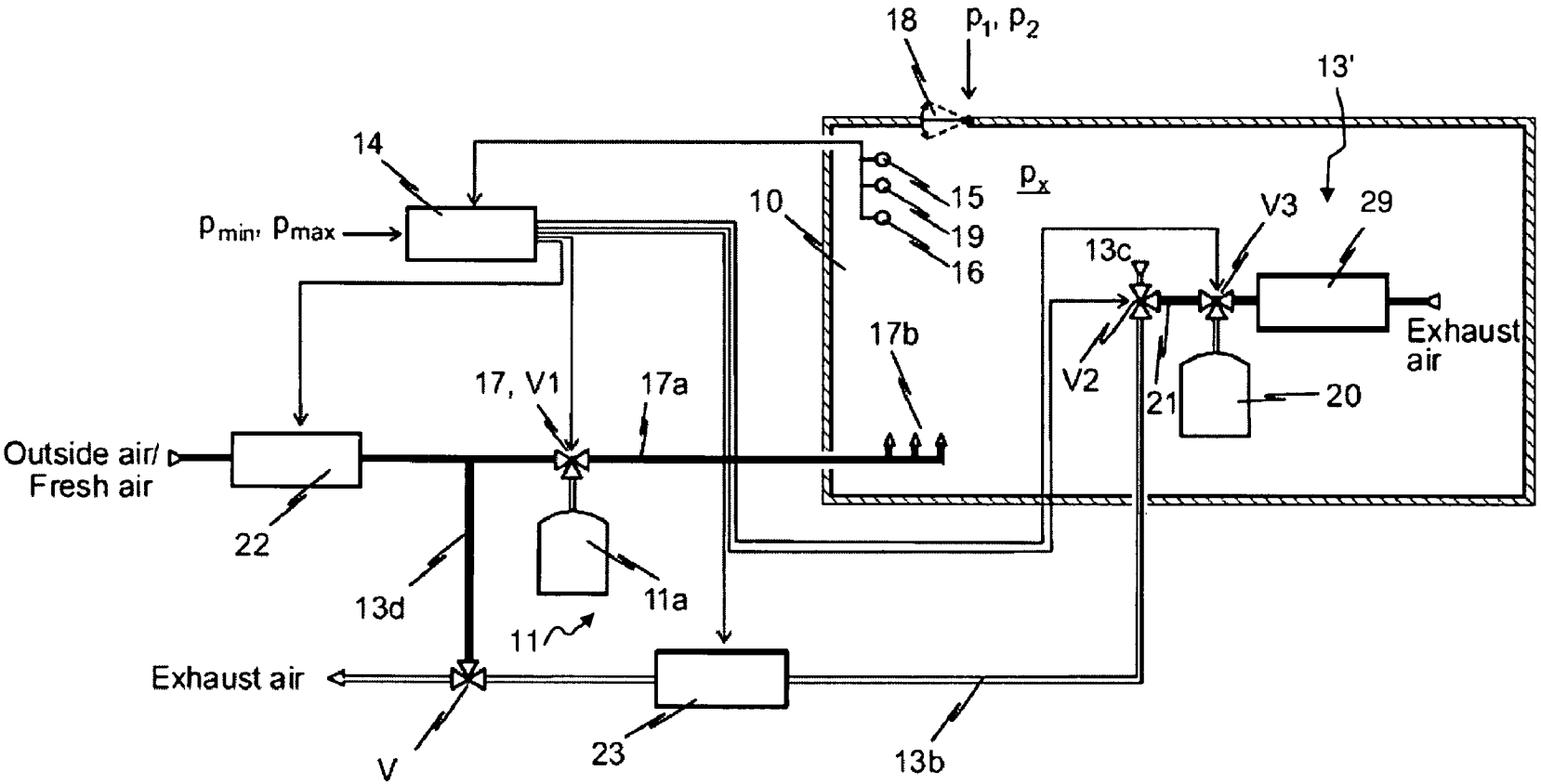
FIG. 2 is a second embodiment of the invention depicted as schematically.

A further preferred embodiment of the device according to the invention is shown in a schematic representation in FIG. 2. The embodiment depicted in FIG. 2 corresponds substantially to the embodiment previously described with reference to FIG. 1; however no intake mechanism is used as a negative-pressure generating mechanism 13' in the system according to FIG. 2. Instead, a compressor 29 provided in the interior of space 10 is employed as a negative-pressure generating mechanism 13' which thereby serves as needed to compress the volume of at least a portion of the exhaust air to be discharged from the gaseous ambient atmosphere.

A high-pressure storage reservoir 20 connected to the compressor 29 is further provided in which compressed exhaust air can be buffered by means of the compressor 29. The high-pressure storage reservoir 20 is connected via a three-way valve V2, V3 to a pipeline system 13*b*, 21 leading to the exterior, through which exhaust air compressed by the compressor 29 and/or compressed exhaust air buffered in the high-pressure storage reservoir 20 can be discharged from the interior of space 10.

The device depicted in FIG. 2 further includes a supply air system having a supply air fan 22, by means of which fresh air can be supplied to the compartment atmosphere through the supply pipe system 17*a* and the outlet nozzle system 17*b*. An exhaust air system having an extraction fan 23 is additionally provided, which is connected to the interior of the space 10 by means of the intake system 13*b* and the suction opening 13*c* and can extract exhaust air to the outside in regulated manner. Both the supply air fan 22 as well as the extraction fan 23 can be correspondingly controlled by the control unit 14.

It is in this way possible to provide for a deliberate exchange of air in enclosed space 10 in order to have an exchange of air between the air inside the space and the outside or fresh air. In occupied rooms, for example, an exchange of air is necessary to supply oxygen, to dispel carbon dioxide and to extract condensation. But an exchange of air is also frequently necessary in stockrooms which people do not or only briefly enter, for example in order to remove harmful elements released by the goods stored in the stockroom. If the shell of the building or the space is designed to be virtually airtight, as modern building methods call for, there can no longer be any unregulated exchange of air which would result in an undesired and uncontrolled exchange of substances between the compartment atmosphere and the external atmosphere. A ventilation system can be employed to provide the necessary exchange of air for such spaces.

A ventilation system is a mechanism which serves to supply fresh air to living or working spaces and respectively remove "used" or impure exhaust air. Depending on application, there are systems having controlled supply air (supply air systems), controlled exhaust air (exhaust air systems) or combined supply/exhaust air systems.

The embodiment depicted in FIG. 2 utilizes a gas cylinder battery 11*a* as the inert gas source, same being connected to the supply pipe system 17*a* by means of the three-way valve V1. The intake pipe system 13*b* is likewise connected to the supply pipe system 17*a* by means of a branch line 13*d* and a three-way valve V4. Valves V2 and V4 are applicably actuatable by the control unit 14 such that the branch line 13*d*, the valves V2, V4, the extraction fan 23 and the pipeline system 13*b* constitute a circulation system.

Although it is not explicitly depicted in the representation according to FIG. 2, a volume flow sensor can be provided in the supply pipe system 17*a* to measure the total volume flow supplied to the compartment atmosphere and convey the measured value to the control unit 14. The total volume flow supplied to the compartment atmosphere per unit of time is comprised of the fresh air volume flow and the inert gas or extinguishing agent volume flow.

A corresponding volume flow sensor (although not explicitly depicted in FIG. 2) can also be further provided in the pipeline system 13*b* or 21 to measure the exhaust volume extracted per unit of time from the interior of the space with the exhaust air system and convey the measured value to the control unit 14. In accordance with the invention, it is thereby provided for the control unit 14 to compare the measured supply air volume flow to the measured exhaust air volume flow and accordingly control the supply/exhaust system such that the supply air volume flow is at all times less than or equal to the exhaust air volume flow. By so doing, a reduced atmospheric pressure compared to the normal external atmospheric pressure can be set and/or maintained in the space 10.

As is also the case with the embodiment described with reference to FIG. 1, the control unit 14 is designed to actuate valve V1 as needed so as to form a fluidic connection between the inert gas source 11*a* and the supply pipe system 17*a* such that the inert gas (gaseous extinguishing agent) provided by the inert gas source 11*a* can be supplied to the compartment atmosphere in regulated fashion. Since in the event of a fire, it is necessary to lower the oxygen content in the compartment atmosphere to at least the re-ignition prevention level as quickly as possible, upon the detection of a fire characteristic, the supplying of fresh air as supply air is ceased and only extinguishing agent from inert gas source 11*a* is supplied to the compartment atmosphere. Compared to the normal state, the supply air volume flow thereby increases considerably, which—if there were no provisions for pressure equalization or pressure compensation—would lead to an increase in pressure in the interior of space 10.

In order to prevent this, the embodiment depicted in FIG. 2 makes use of the negative-pressure generating mechanism 13' which compresses the volume of at least a portion of the exhaust air to be discharged from the compartment atmosphere and buffers same in the previously-mentioned high-pressure storage reservoir 20. The remaining portion of the exhaust air to be discharged from the compartment atmosphere is extracted by the exhaust system.

The providing of the negative-pressure generating mechanism 13' thus enables the exhaust air volume flow to then also be at least equal to the supply air volume flow when inert gas is suddenly fed into space 10 and the exhaust air system as such is not designed to extract a sufficiently large enough exhaust air volume flow from the compartment atmosphere.

Figure 3:
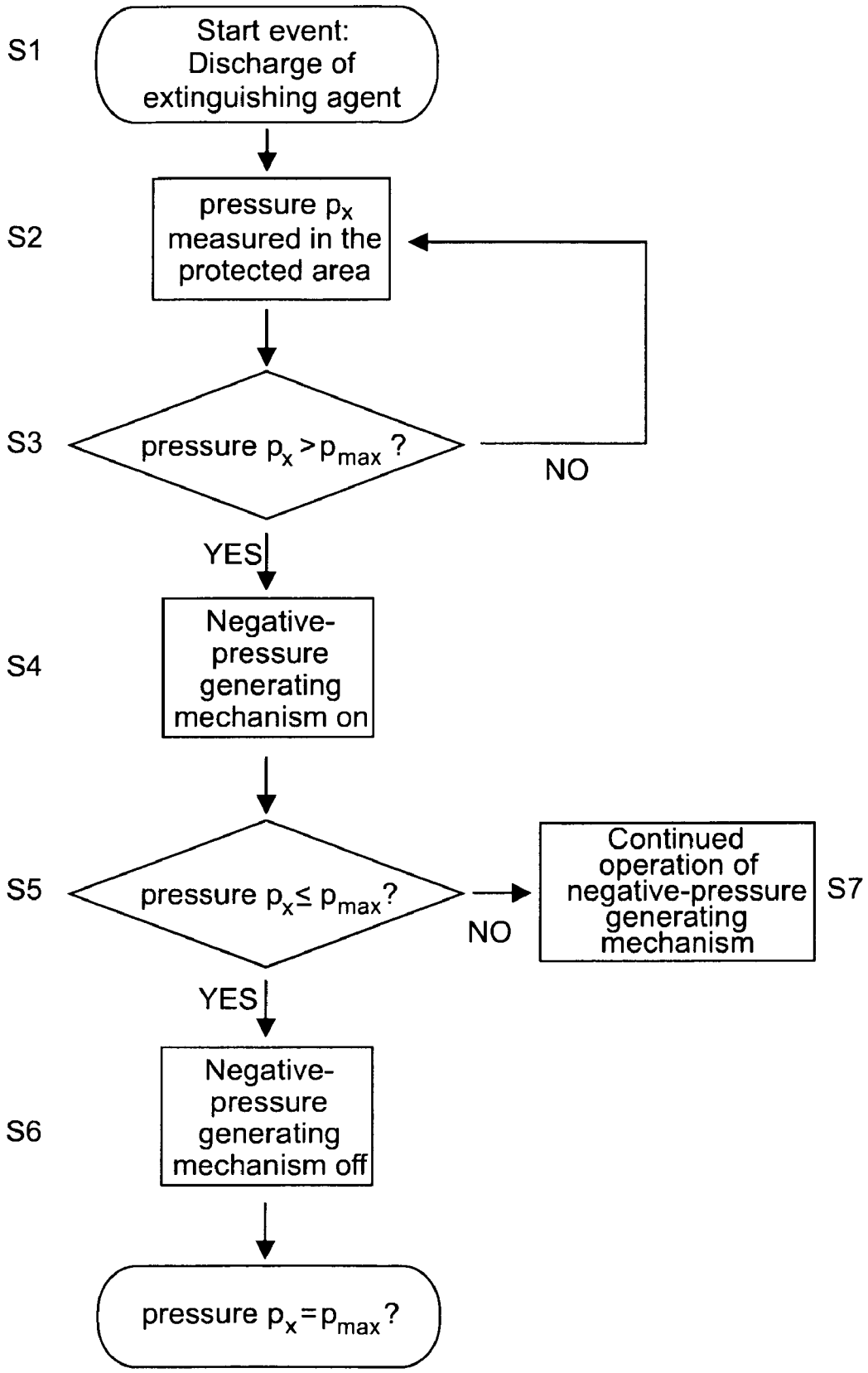
FIG. 3 is a flowchart illustrating the pressure compensation or pressure relief realizable in an enclosed space according to the invention.

The explicit functioning of the pressure relief or pressure compensation realized with the inventive solution is represented again schematically in the flowchart of FIG. 3.

The pressure relief or pressure compensation in the interior of space 10 is initiated as soon as gaseous extinguishing agent is introduced into the protected area from inert gas source 11*a* (Step S1). The compartment pressure $p_x$ within space 10 is then measured by the pressure-measuring mechanism 15 and the measured pressure value fed to the control unit 14 (Step S2). Thereafter, the control unit 14 determines whether the measured pressure valve $p_x$ has reached a maximum limit value $p_{max}$ which is predefinable at will and preferably stored in a memory of the control unit (Step S3). If not (NO), the process returns to the second method step on the flowchart (Step S2) of measuring the momentary pressure $p_x$ within space 10.

However, should it be determined in method step S3 that the measured pressure value $p_x$ has reached the predefined limit value $p_{max}$ (YES), the control unit 14 will send an applicable control signal to the negative-pressure generating mechanism 13 (Step S4). The negative-pressure generating mechanism 13 discharges exhaust air from the compartment atmosphere of the enclosed space 10 for as long as needed until the compartment pressure $p_x$ reassumes a value below the predefined limit value $p_{max}$ (Steps S5 to S7).

As already described above, the negative-pressure generating mechanism 13 can either be configured as an exhaust air system including an intake mechanism 13*a* which extracts exhaust air from the (gaseous) compartment atmosphere and discharges it out of the spatial volume in regulated fashion. On the other hand, however, it is also conceivable for the negative-pressure generating mechanism 13' to include a compressor 29 in order to compress the volume of exhaust air to be discharged from the atmosphere of the space for the purpose of pressure compensation, thereby rendering a release of pressure.

Although it is not depicted in FIG. 1 or 2, it might be necessary to provide a filtering mechanism in the exhaust pipe system 13*b* in order to appropriately purify or treat the exhaust air extracted from the compartment atmosphere and from the spatial volume prior to either resupplying same to the compartment atmosphere as supply air or discharging it to the external atmosphere as exhaust air.

The inventive solution is not limited to fire extinguishing systems which only provide a measure to suppress fire by suddenly introducing an extinguishing gas into the enclosed space 10 in the event of a fire. It is also conceivable for the inventive solution to be employed for example in a so-called two-stage inerting system as described for example in the German DE 198 11 851 A1 patent application.

In such a case, it is preferred for the inert gas or inert gas mixture utilized as the extinguishing agent to render fire suppression or fire extinguishing based on the so-called smothering effect.

It is moreover of advantage for the device to further include an oxygen-measuring mechanism 19 to measure the oxygen content in the compartment atmosphere of the enclosed space 10. This oxygen-measuring mechanism 19—as is also the mechanism 16 to detect at least one fire characteristic—is preferably designed as an aspirative system. In realizing the mechanism 16 for detecting a fire characteristic and in realizing the oxygen-measuring mechanism 19, it would be conceivable to utilize one and the same aspiratively-working system, whereby additionally to the fire characteristic sensor, an oxygen sensor or detector is then arranged in the system's detection chamber to measure the oxygen content within the compartment atmosphere of enclosed space 10.

When the inventive solution is employed in a single-stage or multi-stage inerting system, it is preferred for the inert gas source to include an inert gas generating system 11*b*', 11*b*" additionally to the gas cylinder battery 11*a* (cf. FIG. 1). The inert gas generating system 11*b*', 11*b*" includes an ambient air compressor 11*b*" and an inert gas generator 11*b*' connected thereto. The control unit 14 should thereby be designed to control the air feed rate of the ambient air compressor 11*b*" by means of the appropriate control signals. By so doing, the control unit 14 can establish the volume of inert gas supplied by the inert gas system 11*b*', 11*b*" per unit of time.

The inert gas supplied by the inert gas system 11*b*', 11*b*" is supplied to the monitored space 10 in regulated fashion through the supply pipe system 17*a*. Of course, a plurality of protected areas can also be connected to the supply pipe system 17*a*. Specifically, the inert gas provided by the inert gas system 11*b*', 11*b*" is supplied by means of the outlet nozzles 17*b* arranged at the appropriate locations within the interior of space 10.

In this further development of the inventive solution, the inert gas, advantageously nitrogen, is extracted locally from the ambient air. The inert gas generator, nitrogen generator 11*b*' respectively, functions for example, according to membrane or PSA technology as known from the prior art in order to produce nitrogen-enriched air of, for example, 90% to 95% nitrogen by volume. This nitrogen-enriched air serves as the inert gas supplied to space 10 through the supply pipe system 17*a*. The oxygen-enriched air resulting from the inert gas production is discharged to the outside through a further pipe system.

It would hereby be specifically conceivable for the control unit 14 to control the inert gas system 11*b*', 11*b*" as a function of an inerting signal input to the control unit 14 such that the volume of inert gas supplied and introduced into space 10 assumes a value suited to the setting and/or maintaining of a predefined inertization level in space 10. The desired inertization level can be selected at control unit 14 for example, by means of a key switch or a password-protected control panel (not explicitly shown). It is of course also conceivable for the inertization level to be selected pursuant a predefined sequence of events.

The inventive solution is not limited to the embodiments as depicted as examples in the drawings. Instead, modifications of the described features as specified in the attached claims are also conceivable.

It is in particular conceivable to not use a gas cylinder battery external the enclosed space 10 as the inert gas source 11 but rather provide a high-pressure pipe inside the enclosed space 10. At least a portion of the extinguishing agent provided should be stored under high pressure in this high-pressure pipe. The high-pressure pipe is to further include at least one outlet valve actuatable by the control unit 14 and allocated to the extinguishing agent supply mechanism 17.

Finally, the invention is not limited to the embodiments of the inerting system as depicted in the drawings. Instead, all the advantages and further developments as described in general and specified in the claims are to be considered integral to the invention.

What is claimed is:

1. An inerting method for preventing fire and for extinguishing fire in a compartment, comprising:

supplying fresh air in a regulated manner to a compartment atmosphere as supply air and discharging exhaust air from the compartment atmosphere in a regulated manner; and supplying an extinguishing agent which is gaseous under normal conditions to the compartment atmosphere as the supply air, should a fire occur or to prevent a fire;

wherein a reduced compartment pressure ($p_x$) can be set and/or maintained in the compartment compared to a normal atmospheric pressure by a total volume flow of the supply air supplied to the compartment atmosphere as fresh air and/or as extinguishing agent which is less than or equal to a volume flow of exhaust air discharged from the compartment atmosphere, wherein a pressure difference between a compartment pressure prevailing in the compartment and an air pressure of the ambient atmosphere is further measured continuously or at predefinable times and/or upon predefinable events and the pressure difference is compared to a predefinable value to obtain a comparison between the pressure difference and the predefinable value, and wherein the total volume flow of the fresh air and/or extinguishing agent supplied to the compartment atmosphere as supply air and the volume flow of the exhaust air discharged from the compartment atmosphere is regulated as a function of the comparison between the pressure difference and the predefinable value.

2. The method according to claim 1, wherein when the extinguishing agent is supplied as the supply air, at least a portion of the exhaust air to be discharged or already discharged from the compartment atmosphere is compressed by a compressor, and wherein the intake volume of said compressor is greater than or equal to the total volume flow of the fresh air and/or extinguishing agent supplied to the compartment atmosphere as supply air.

3. The method according to claim 2, wherein the exhaust air discharged from the compartment atmosphere and compressed by the compressor is buffered in compressed form in a high-pressure storage reservoir.

4. The method according to claim 2, wherein at least a portion of the exhaust air compressed by the compressor is released to the outside following treatment, including filtering or sterilization.

5. The method according to claim 1, wherein the respective volume flows of the fresh air supplied as supply air, the discharged exhaust air and the extinguishing agent supplied as supply air in the event of a fire or to prevent a fire, are further measured, and wherein the respective volume flows are regulated such that a difference between the total volume flow of the fresh air and/or extinguishing agent supplied to the compartment atmosphere as supply air and the volume flow of the exhaust air discharged from the compartment atmosphere can have a constant predefinable value at all times.

6. The method according to claim 5, wherein the compartment exhibits a gas/aerosol-tight spatial shell, and wherein the constant predefinable value is zero.

7. The method according to claim 1, wherein the total volume flow of the fresh air and/or extinguishing agent supplied to the compartment atmosphere as supply air is exactly the same as the volume flow of the exhaust air discharged from the compartment atmosphere when the difference determined between the compartment pressure ($p_x$) and the air pressure of the ambient air corresponds to the predefined value.

8. The method according to claim 1, wherein the total volume flow of the fresh air and/or extinguishing agent supplied to the compartment atmosphere as supply air is less than the volume flow of the exhaust air discharged from the compartment atmosphere when the difference determined between the compartment pressure ($p_x$) and the air pressure of the ambient air is less than the predefined value.

9. The method according to claim 1, wherein the difference between the compartment pressure ($p_x$) and the air pressure of the ambient atmosphere can be determined by measuring the pressure ($p_x$) within the compartment and the air pressure of the ambient atmosphere.

10. The method according to claim 1, wherein the compartment atmosphere is subject to detection of at least one fire characteristic continuously or at predefinable times or upon predefined events, and wherein in the event a fire characteristic is detected, the extinguishing agent is supplied to the compartment atmosphere as supply air.

11. The method according to claim 10, wherein in the event a fire characteristic is detected, the fresh air normally supplied as the supply air is discontinued.

12. The method according to claim 10, wherein the volume flow of the extinguishing agent supplied to the compartment atmosphere in the event of a fire characteristic being detected is greater than the volume flow of the fresh air normally supplied to the compartment atmosphere.

13. The method according to claim 1, wherein to prevent fire, the compartment atmosphere is supplied with both fresh air and extinguishing agent as supply air.

14. The method according to claim 13, wherein an extinguishing agent concentration in the compartment atmosphere is determined continuously or at predefinable times or upon predefined events, and wherein the volume flow of the extinguishing agent supplied to the compartment atmosphere for a purpose of preventing fire is regulated as a function of a determined extinguishing agent concentration such that a predefinable extinguishing agent concentration can be set and/or maintained in the compartment atmosphere.

15. The method according to claim 14, wherein the extinguishing agent is an inert gas or an inert gas mixture, and wherein the extinguishing agent concentration in the compartment atmosphere is determined indirectly by measuring the oxygen content.

16. The method according to claim 15, wherein the volume flow of the inert gas or inert gas mixture supplied to the compartment atmosphere for the purpose of preventing fire is regulated such that a base inertization level is set and maintained in the compartment atmosphere which is above the re-ignition prevention level characteristic for the compartment, and wherein in the event of a fire, the volume flow of the inert gas or inert gas mixture supplied to the compartment atmosphere is regulated such that a full inertization level which is equal to or below the re-ignition prevention level characteristic for the compartment is set and maintained.

17. The method according to claim 1, wherein a quality of the compartment air is determined continuously or at predefinable times and/or upon predefinable events, and wherein the volume flow of the fresh air supplied to the compartment atmosphere as supply air is regulated as a function of a determined compartment air quality.

18. The method according to claim 17, wherein the quality of the compartment air is determined indirectly by measuring the $CO_2$ content in the compartment atmosphere.

19. The method according to claim 1, wherein at least a portion of the exhaust air discharged from the compartment atmosphere after being treated is supplied back to the compartment atmosphere again as fresh air.

20. A device for preventing fire and for extinguishing fire in a compartment, comprising:

at least one mechanism for providing an extinguishing agent which is gaseous under normal conditions and for immediately introducing said gaseous extinguishing agent into a compartment atmosphere of the compartment, when a fire has broken out in said compartment, a pressure relief mechanism having a negative-pressure generating mechanism;

a control unit;

a common supply pipe system through which fresh air is supplied in a regulated manner to the compartment atmosphere as supply air and through which exhaust air is discharged from the compartment atmosphere in a regulated manner; and a pressure-measuring mechanism to measure a physical pressure of the gas within the compartment atmosphere, wherein the pressure-measuring mechanism is designed to measure a momentary compartment pressure ($p_x$) continuously or at predefined times or upon predefined events and feed said measured values to the control unit, wherein the control unit is designed to accordingly actuate the negative-pressure generating mechanism on the basis of said momentary pressure value ($p_x$) and to control the negative-pressure generating mechanism subject to the pressure ($p_x$) prevailing in the compartment atmosphere of the compartment such that the pressure ($p_x$) prevailing in the compartment atmosphere does not exceed a predefinable maximum pressure value ($p_{max}$).

21. The device according to claim 20, wherein the control unit controls the negative-pressure generating mechanism subject to the pressure ($p_x$) prevailing in the compartment atmosphere such that the atmospheric pressure ($p_x$) prevailing in the compartment atmosphere does not fall below a predefinable minimum pressure value ($p_{min}$).

22. The device according to claim 20, wherein the negative-pressure generating mechanism comprises a compressor to compress at least a portion of the exhaust air discharged from the compartment atmosphere and a high-pressure storage reservoir to buffer the exhaust air compressed by the compressor.

23. The device according to claim 22, wherein the compressor is actuatable by the control unit such that the intake volume of the compressor is greater than or equal to the total volume flow of the fresh air and/or extinguishing agent supplied to the compartment atmosphere as supply air.

* * * * *